US006258013B1

(12) United States Patent
Dabney

(10) Patent No.: US 6,258,013 B1
(45) Date of Patent: Jul. 10, 2001

(54) PROTECTIVE TARGET APPARATUS TO AID IN THE PRACTICE OF MARTIAL ARTS

(76) Inventor: Roger W. Dabney, 1806 Nascelle La., Richmond, VA (US) 23228

( * ) Notice: Subject to any disclaimer, the term of this patent is extended or adjusted under 35 U.S.C. 154(b) by 0 days.

(21) Appl. No.: 09/022,743

(22) Filed: Feb. 13, 1998

(51) Int. Cl.[7] ..... A63B 69/34
(52) U.S. Cl. ..... 482/83; 482/87; 482/88
(58) Field of Search ..... 273/348, 403, 273/407, 408, 440.1; 482/83–90; 473/441, 444, 442, 443

(56) References Cited

U.S. PATENT DOCUMENTS

| | | | | |
|---|---|---|---|---|
| 2,574,046 | * | 11/1951 | Logan | 473/444 |
| 2,994,534 | * | 8/1961 | Davis et al. | 473/444 |
| 3,329,431 | * | 7/1967 | Roesner | 273/403 |
| 3,759,515 | * | 9/1973 | Crooks | 482/88 |
| 3,855,633 | | 12/1974 | Rhee . | |
| 3,896,497 | | 7/1975 | Rhee . | |
| 4,077,624 | | 3/1978 | Feaser . | |
| 4,111,415 | | 9/1978 | Reitano . | |
| 4,201,379 | | 5/1980 | Williams . | |
| 4,478,408 | | 10/1984 | Bruckner . | |
| 4,546,966 | * | 10/1985 | Segura | 482/86 |
| 4,974,833 | | 12/1990 | Hartman et al. . | |
| 4,991,231 | | 2/1991 | Swift . | |
| 5,209,691 | * | 5/1993 | Ekstein | 42/88 |
| 5,232,368 | * | 8/1993 | Morgia | 482/88 |
| 5,254,062 | | 10/1993 | Hoffman . | |
| 5,277,679 | | 1/1994 | Wells . | |
| 5,281,191 | * | 1/1994 | DeSousa | 473/442 |
| 5,308,084 | * | 5/1994 | Morrell | 273/403 |
| 5,362,289 | | 11/1994 | Holt . | |
| 5,458,552 | | 10/1995 | Mara . | |
| 5,542,667 | | 8/1996 | Lezdey et al. . | |
| 5,582,561 | | 12/1996 | Gonzalez . | |

OTHER PUBLICATIONS

Century Martial Art School Product Catalog, Fall 1996, Cover Page and pp. 15–17 and 77.

* cited by examiner

*Primary Examiner*—Jerome W. Donnelly
(74) *Attorney, Agent, or Firm*—Sanford J. Piltch

(57) ABSTRACT

A protective martial arts practice target pad for use in the practice of various martial arts activities in which blows and thrusts are directed at a human subject is comprised of a resilient energy-absorbing base member sized to protect the body area of the human subject at which one or more blows or thrusts are directed, support and gripping straps for stabilizing and positioning the pad over the body area of the human subject adapted to be held using the arms and hands and a pre-determined target space defined by one or more protrusions extending outward from the pad along one or more sides of the target space to provide immediate feedback by contact or lack of contact indicating either a misdirected or properly directed blow or thrust falling within the pre-determined target space. The target space may be configured as various shapes conforming to the shape of the extremity used for the blow or thrust.

7 Claims, 6 Drawing Sheets

PROTECTIVE TARGET APPARATUS TO AID IN THE PRACTICE OF MARTIAL ARTS

BACKGROUND OF THE INVENTION

This invention relates to a martial arts practice target which provides for protection to the hand, forearm and body of the user by absorbing energy from a blow or thrust occasioned by a practitioner training to engage in various sports such as karate or other related martial arts sports.

Protective devices used in the practice of martial arts sports have been previously known and used. Such devices have been designed to be worn or mounted on the hand and generally include a portion which is designed to absorb a blow or thrust occasioned by a martial arts practitioner. Some of such known prior devices are those which appear in U.S. Pat. Nos. 3,896,497 [Rhee], 4,478,408 [Bruckner] and 4,991,231 [Swift]. The Rhee patent describes an energy absorbing protective device which is substantially cylindrical in shape into which an instructor's hand may be inserted to grip and hold the protective device during training and contests of various martial arts. The device described in the Rhee patent is constructed of two (2) circular pads arranged next to one another with a space between for the insertion of the user's hand. Each of the pads contain resilient foam as the energy absorbing medium and are covered by a pliable coating, all for absorbing the energy from a thrust or blow. The device is specifically designed for use as a target in martial arts training exercises, but does not describe or disclose a target image or a limited target space toward which the thrust or blow is to be directed during training or in contests.

The Bruckner patent describes a mitt-shaped substantially as a parallelpipehead which has a central recess extending longitudinally along the greater dimension of the mitt for receiving the hand and a part of the forearm of a user. Within the recess of the mitt or pad, at approximately one-third (⅓) from one end thereof, a cross piece is positioned for providing an internal grip so that the user is able to grasp the pad tightly so as not to have the pad knocked away when absorbing a blow or thrust in a practice session. Although the Bruckner protective device provides resilient foam material for absorbing the energy from the thrust or blow in a martial arts training or contest session, there are no target images or restricted target space incorporated as part of the device.

The Swift patent describes a target pad in the shape of a human head into which the hand and wrist of a user may be inserted with the shape of the pad defining a curvilinear target image. While this target pad is also made of resilient material and describes an opening to receive the hand for holding the pad, it also does not exhibit a target image or a limited target space for directing thrusts or blows during a training or contest session. There have been other exercising or practice-aid devices used in martial arts training which do exhibit or display a target. One such device is described in U.S. Pat. No. 4,111,415 [Reitano] which describes an add-on component to an exercising apparatus as a solid rubber square karate kick target attached by straps positioned between an overhead bar and a retaining ring attached to the floor. The kick pad displays a target image for a practitioner to direct thrusts or blows toward the pad and is vertically adjustable in height. However, this practice aid does not limit or restrict the contact point of the thrust or blow to a target space as is considered necessary to properly perfect the appropriate techniques for mastering certain levels of the martial arts, or in successfully acquiring the skills necessary to prevail in a contest for other related sports.

Therefore, several deficiencies for prior practice aids have been noted in that a limited or restricted target space, for movable cushion protective target devices, has not been incorporated into any of the known practice devices. Further, the combined assistance of a displayed target coupled with a restricted or limited striking space to receive the thrust or blow is not believed to be exhibited in the several earlier devices discussed above. This omission is deemed to be a significant deficiency in that it is believed to be extremely important to the progress of learning any martial art for the practitioner to experience the eye and extremity coordination by immediate feedback from any misplaced thrust or blow. The prior devices do not provide any such feedback as is contemplated by the present invention. In particular, when a practitioner moves to strike a thrust or blow and merely strikes a smooth, resilient surface of the protective pad, that practitioner does not know whether he or she has struck at the optimal location or exhibited the proper technique or form. If the striking space were restricted or limited in size, and the striking space displayed a unique target image, the practitioner would be greatly assisted in immediately receiving physical feedback from a misplaced strike or blow performed incorrectly or not falling within the restricted or limited space for the target area.

Thus, the present invention is directed to providing the combination of a resilient pad used as a practice striking target which is capable of protecting the hand, forearm or body of the instructor and providing the learner or practitioner with a limited or restricted striking space with a visual target display, where such target space falls within a raised peripheral wall of the target space so that a misplaced blow is immediately felt and observed by the learner or practitioner, as well as the instructor. Such a device clearly reinforces, by feel, as well as by sight, where the blow actually was received versus where the blow was intended to be directed.

It is, therefore, an object of the present invention to provide a protective martial arts practice target pad capable of absorbing the energy from a thrust or blow in order to protect the user or instructor from such blows.

It is a further object of the present invention to provide such protective target device with a limited or restricted target space with a peripheral wall adjacent and/or surrounding a target image displayed for the learner or practitioner within the target space in order to provide immediate feedback through the contact of the extremities of the learner or practitioner with the protective target device to know exactly where the directed blow made contact with the device.

Further objects of the present invention will become evident hereinafter.

SUMMARY OF THE INVENTION

A protective target apparatus for use in the practice of various martial arts activities in which blows and thrusts are thrown at a human subject by a practitioner is described comprising a resilient energy-absorbing pad sized to protect the body area of the human subject at which one or more blows and thrusts are directed having a front and a back, a support and gripping means for stabilizing and positioning the pad over the body area of the human subject at which the blows and thrusts are directed attached along the back of the pad and a targeting means for directing the blows and thrusts to a pre-determined target space defined by one or more protrusions extending outward from the front of the pad and surrounding on one or more sides said target space and for providing immediate feedback to said practitioner by contact with said one or more protrusions indicating a misdirected blow or thrust or by lack of contact with said one or more protrusions indicating a properly directed blow or thrust falling within the pre-determined target space. The one or more protrusions may be comprised of a single linear upstanding wall immediately adjacent to said target space, a pair of linear upstanding parallel walls located on opposite sides of said target space, three linear upstanding walls surrounding said target space and configured to form a triangular target space, two sets of linear upstanding walls, each of said sets of walls containing walls parallel to the other wall of said set, surrounding said target space and forming a rectangular or a square target space, or a curvilinear upstanding wall surrounding said target space and forming an ellipsoidal or circular target space. The targeting means further comprises a visual target display located within the target space toward which said blows and thrusts are to be directed.

The support and gripping means is comprised one or more retaining straps extending across the back of the pad for receiving the forearm and hand of the user and a gripping strap positioned along one side of the back of the pad to accommodate grasping by a user for stabilizing and for positioning the pad. The support and gripping means may also be comprised of one or more retaining straps extending across the back of the pad for receiving the forearm and hand of the user and a gripping strap positioned along one side of the back of the pad and a gripping strap positioned on the top or either side of the pad to accommodate grasping of the pad by the opposite hand of a user for stabilizing and for positioning the pad.

BRIEF DESCRIPTION OF THE DRAWINGS

For the purpose of illustrating the invention, there is shown in the drawings forms which are presently preferred; it being understood, however, that the invention is not limited to the precise arrangements and instrumentalities shown.

DETAILED DESCRIPTION OF THE PREFERRED EMBODIMENTS

Figure 1:
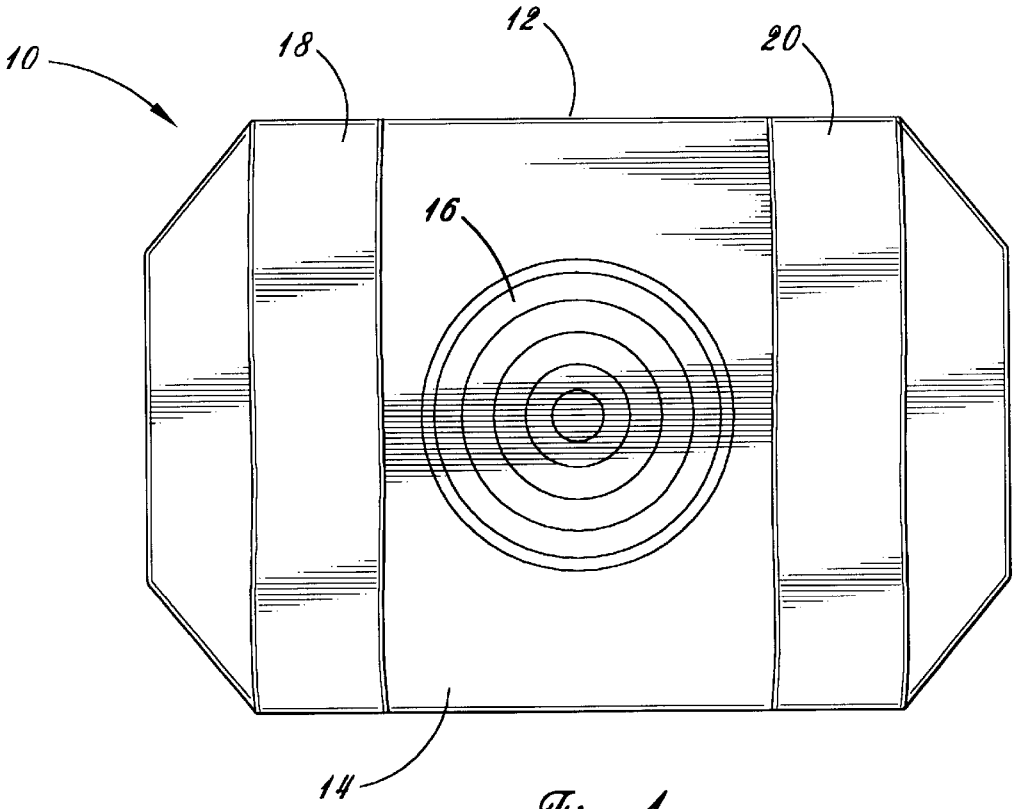
FIG. 1 is a front elevational view of the protective target apparatus of the present invention.

The following detailed description is of the best presently contemplated mode of carrying out the invention. The description is not intended in a limiting sense, and is made solely for the purpose of illustrating the general principles of the invention. The various features and advantages of the present invention may be more readily understood with reference to the following detailed description taken in conjunction with the accompanying drawings.

Referring now to the drawings in detail, where like numerals refer to like parts or elements, there is shown a protective martial arts practice target pad 10 in related FIGS. 1–4. Each of the FIGS. 1–4 show a different side of the pad 10, which pad 10 is described as follows.

The protective martial arts practice target pad 10 is comprised of a base member 12, which is substantially rhombic in shape and rectangular in cross-section, as shown in FIGS. 1–4. Each of the corners of the base member 12 are removed to ease in the positioning of the pad 10 to be discussed below. On the front of the pad 10 is a target area or space 14 which has been shaped and sized to accept a properly directed thrust or blow from one or more extremities of a practitioner or learner of the martial arts. Within the target space 14 is a visually displayed target image 16 which is intended to aid in the visual/physical coordination of the practitioner or learner of the martial arts in properly directing a thrust or blow to an exact site as the pad 10 is positioned over that site of a human subject.

Figure 2:
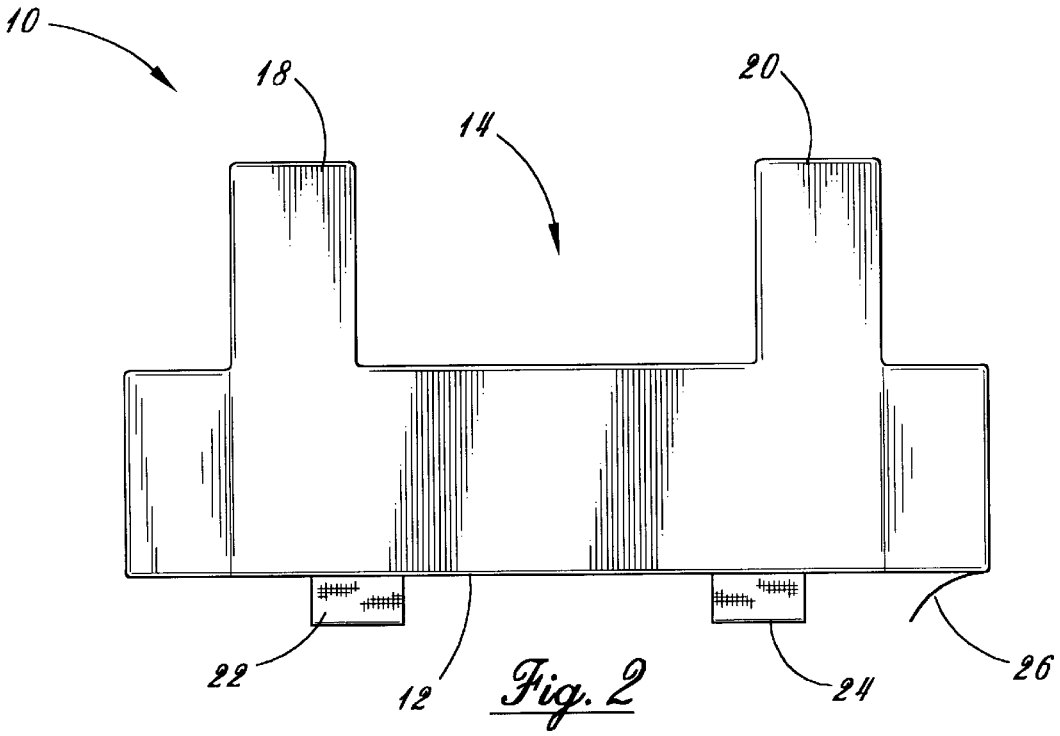
FIG. 2 is a bottom view of the protective target apparatus of the present invention.
Figure 3:
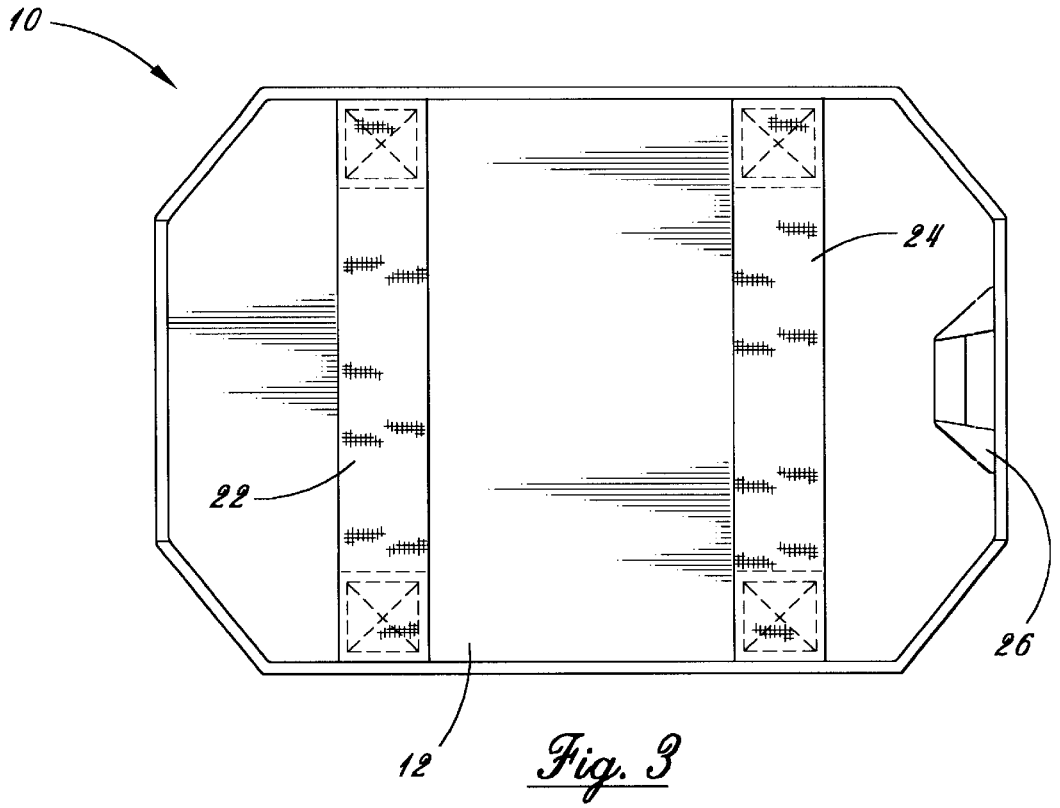
FIG. 3 is a back elevational view of the protective target apparatus of the present invention.
Figure 4:
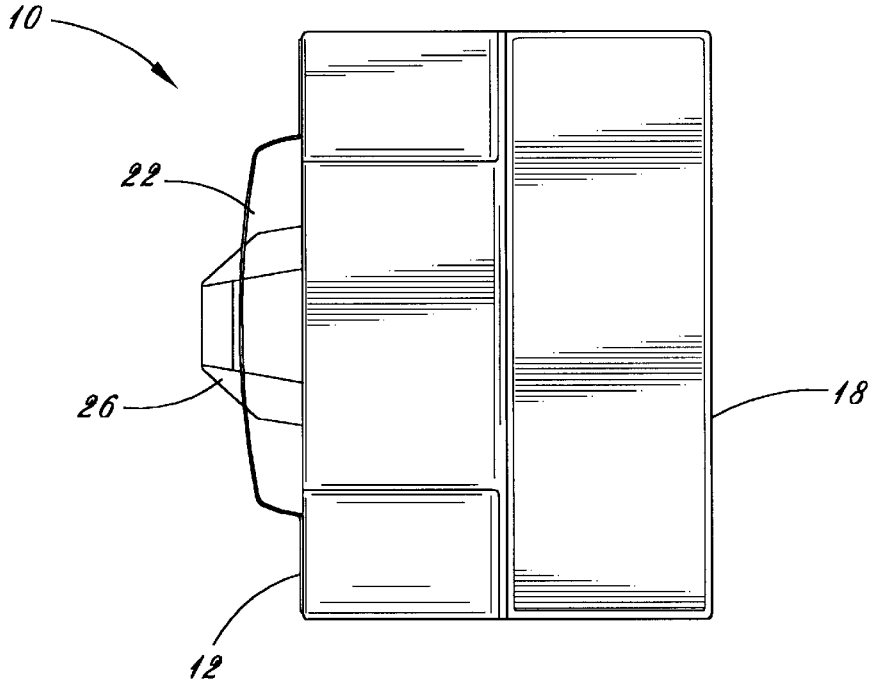
FIG. 4 is a side view of the protective target apparatus of the present invention.

Also on the front of the practice target pad 10, as shown in FIGS. 1, 2 and 4, is one of several different targeting means which define and limit the target space 14 by the pre-determined placement of the targeting means on the pad 10. In this instance, the targeting means can be described as a pair of uniform, linear or straight, protrusions or walls 18, 20 arrayed in a parallel arrangement on opposite sides of the target area such that the protrusions 18, 20 define the target space or area 14 therebetween.

In order to properly support and grip the practice target pad 10, arrayed along the back of the base member 12 are one or more straps 22, 24 which are stitched or otherwise permanently secured to the back or rear surface of the pad 10. These straps 22, 24 are sized in length so that the arm of the user, i.e. the instructor, is able to slip through between the straps 22, 24 and the rear surface of the back of the base member 12 to support the pad 10 over the forearm, wrist and hand area of the user. The straps 22, 24 may be made of a resilient or elastic material so as to hold the arm of the user against the backside of the pad 10.

At the distal end of the pad from which the user inserts his or her arm, a gripping strap 26 is located for the purpose of the user to stabilize the practice target pad 10 on his or her arm, and to provide a hand grip so that the pad will not reposition itself along the arm of the user either before or after a thrust or blow strikes the pad 10.

In this manner, the user, i.e. the instructor, may position the protective martial arts practice target pad, once secured over his/her forearm and hand, in any position over a body area which is intended to receive a blow or thrust such that a properly directed blow or thrust striking the practice target pad will fall within the pre-determined target area as directed by the targeting means, i.e. the forward facing protrusion or walls 18, 20. If the practitioner fails to strike within the target area 14, there is an immediate visual and physical feedback if the extremity of the practitioner strikes one of the targeting means walls 18, 20 rather than the target area 14. In all instances, the protective martial arts practice target pad 10 is sufficient in construction to absorb the energy of the thrust or blow and sufficiently resilient to withstand many such thrusts or blows so that the pad 10 remains undamaged and the user or instructor remains, likewise, uninjured.

What has been described up until this time is a practice target pad 10 which is sized merely to protect the forearm and hand area of a user or instructor. This means that the dimensions of the pad 10 are approximate to the length of the forearm and hand of a user along its longer dimension and about two-thirds as long across its shorter dimensions, as proportionally shown in FIGS. 1–4. The depth of the base member 12 is sufficient to absorb the energy of the thrust or blow and is on the order of 2"–3" in depth. Likewise, the targeting means, i.e. the forward facing protrusions 18, 20, extend forward approximately the same distance as the pad 10 is in depth.

Figure 5:
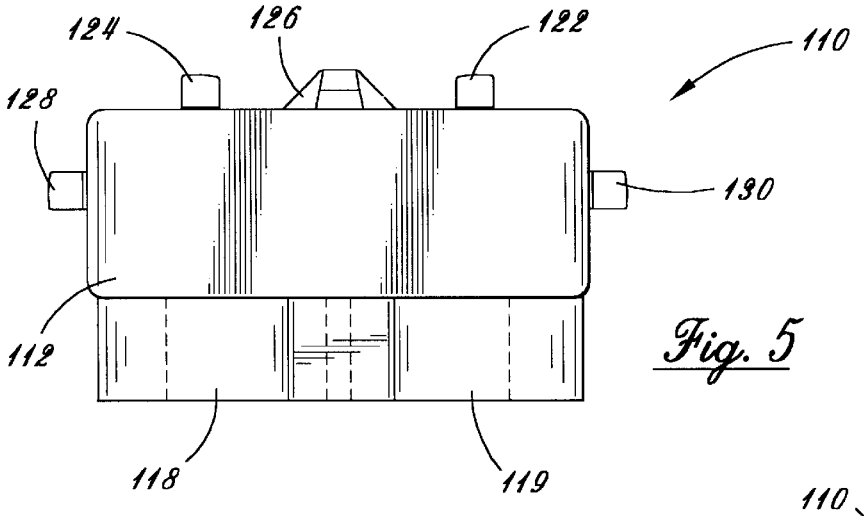
FIG. 5 is a top view of a second embodiment of the protective target apparatus of the present invention.
Figure 6:
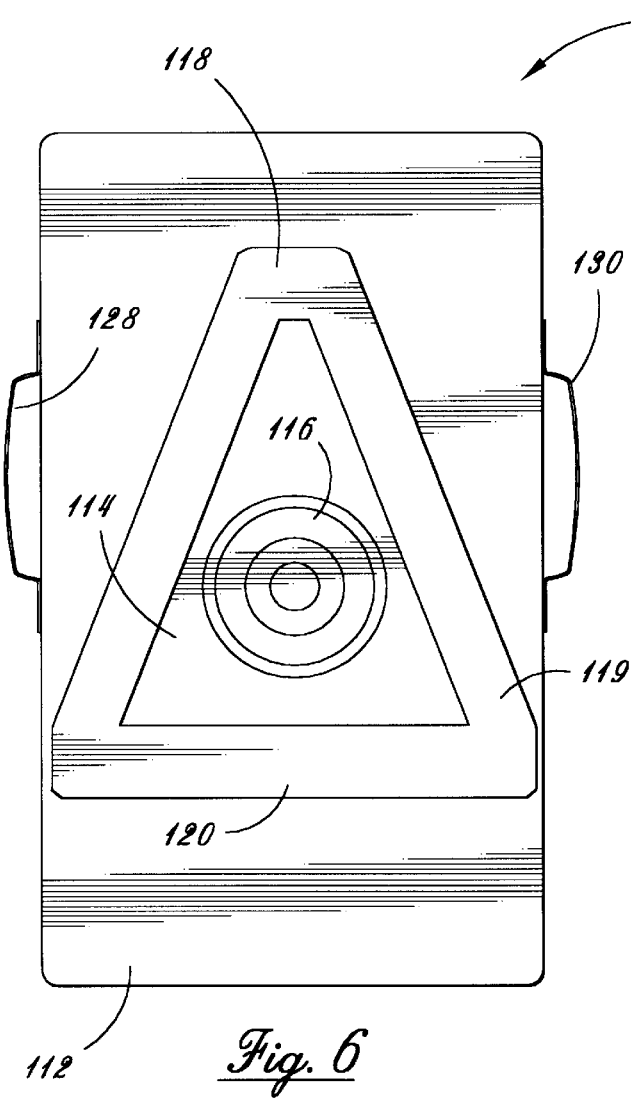
FIG. 6 is a front elevational view of a second embodiment of the protective target apparatus of the present invention.
Figure 7:
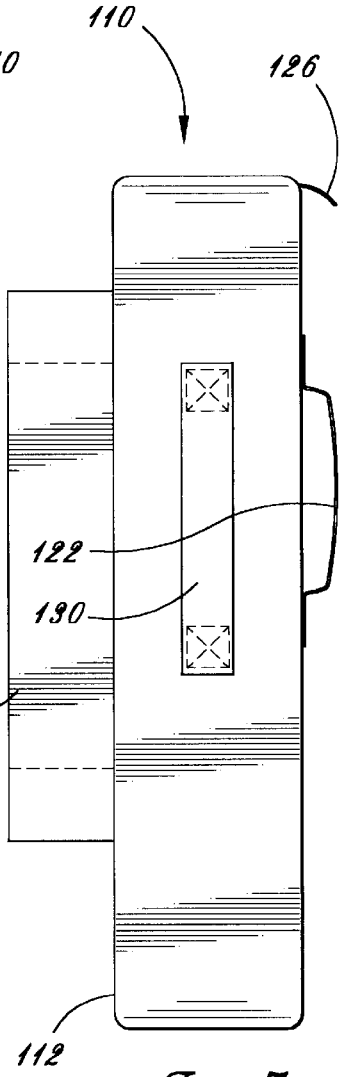
FIG. 7 is a side view of a second embodiment of the protective target apparatus of the present invention.

A second embodiment of the protective target apparatus 110 is shown in FIGS. 5–7 which show a larger practice target pad, a different support and gripping arrangement, and a larger and differently shaped targeting means. The practice target pad 110 is larger in overall dimension in order to protect a greater area of the body against which blows or thrusts are directed in practicing various martial art. The practice target pad 110 also comprises a base member 112 and has a target space or area 114 arrayed across the front of the practice target pad 110 within the target space 114 is a visual target 116 as in the first embodiment. Looking at the front of the practice target pad 110, as shown in FIG. 6, the targeting means may be described as a plurality, in this case three, uniform, linear or straight, walls or protrusions which extend outward from the front of the practice target pad 110. Each of the protrusions or walls 118, 119 and 120 are spatially arrayed so as to form a triangular target area 114 within which the visual target 116 has been placed. The respective ends of the walls or protrusions 118, 120 meet and are shaped so as not to exhibit any sharp corners with the outside bottom dimension approximating the width of the practice target pad 110.

As shown in FIGS. 5 and 7, the practice target pad 110 has a similar support and gripping means to that of the first embodiment as straps 122, 124 are positioned across the back of the practice target pad 110 and fixedly held in place in similar fashion by sewing or other means. However, due to the increased size of the practice target pad 110 from that of the first embodiment, the distal strap 124 serves as a place for which the inserted hand of the user can grip the backside of the practice target pad 110. Again, due to the size of the practice target pad 110, a second gripping position has been found necessary to properly stabilize and position the practice target pad 110. In this case, gripping strap 126 has been placed at the top rear of the practice target pad 110 to be gripped by the opposite hand of the user or instructor. For example, if the instructor inserts his/her left arm through gripping strap 122 and grips strap 124 with his/her hand, the right hand of the user or instructor will grasp gripping strap 126 to stabilize whatever position the practice target pad 110 is to take. Alternatively, additional gripping straps 128, 130 have been placed on either lateral sides of the practice target pad 110 so that the opposite hand of the user or instructor, that which is not engaged through gripping straps 122, 124 may grasp the practice target pad 110 by utilizing gripping strap 128 or gripping strap 130.

The larger protective martial arts practice target pad 110 is utilized to shield and protect larger body areas from blows and thrusts directed at the targeting means where such blows may be directed to the torso of the body or the portions of the extremities nearer the torso. The practice target pad 110 protects these areas, as well as the user or instructor, as in the case of the first embodiment of the present invention by providing sufficient absorbing of the energy from the thrusts or blows directed as the target space 114 so as to protect the user from injury and provide sufficient resiliency so that the practice target pad 110 remains undamaged. As can be seen from FIGS. 5–7, the practice target pad 110 is 2'–3' in height, approximately half that distance in width and approximately 6" in depth. The walls 118, 120 forming the triangular target area 114 extend outward approximately 2"–3" from the front of the practice target pad 110 and the straps are of sufficient resiliency and elasticity, as well as size (length), to accommodate the arm of the user and to retain the arm against the rear of the practice target pad 110. The various gripping straps 126, 128 and 130 are of sufficient size to accommodate grasping by the hand of the user such that the practice target pad 110 is properly positioned and stabilized to receive any blow or thrust during a practice session for martial arts training.

Figure 9:
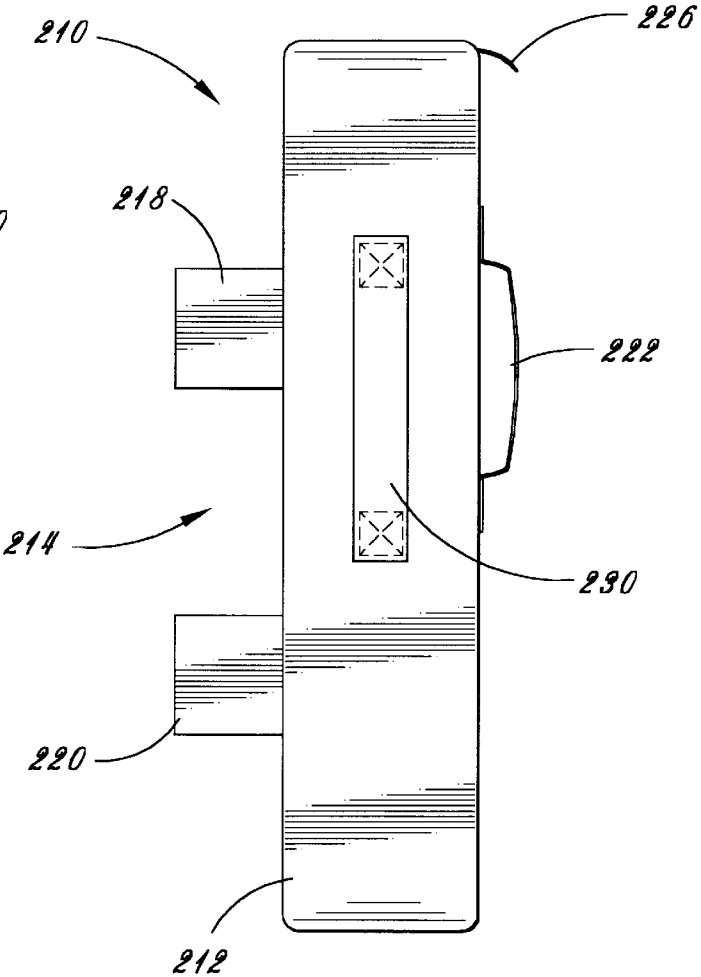
FIG. 9 is a side view of a third embodiment of the protective target apparatus of the present invention.
Figure 8:
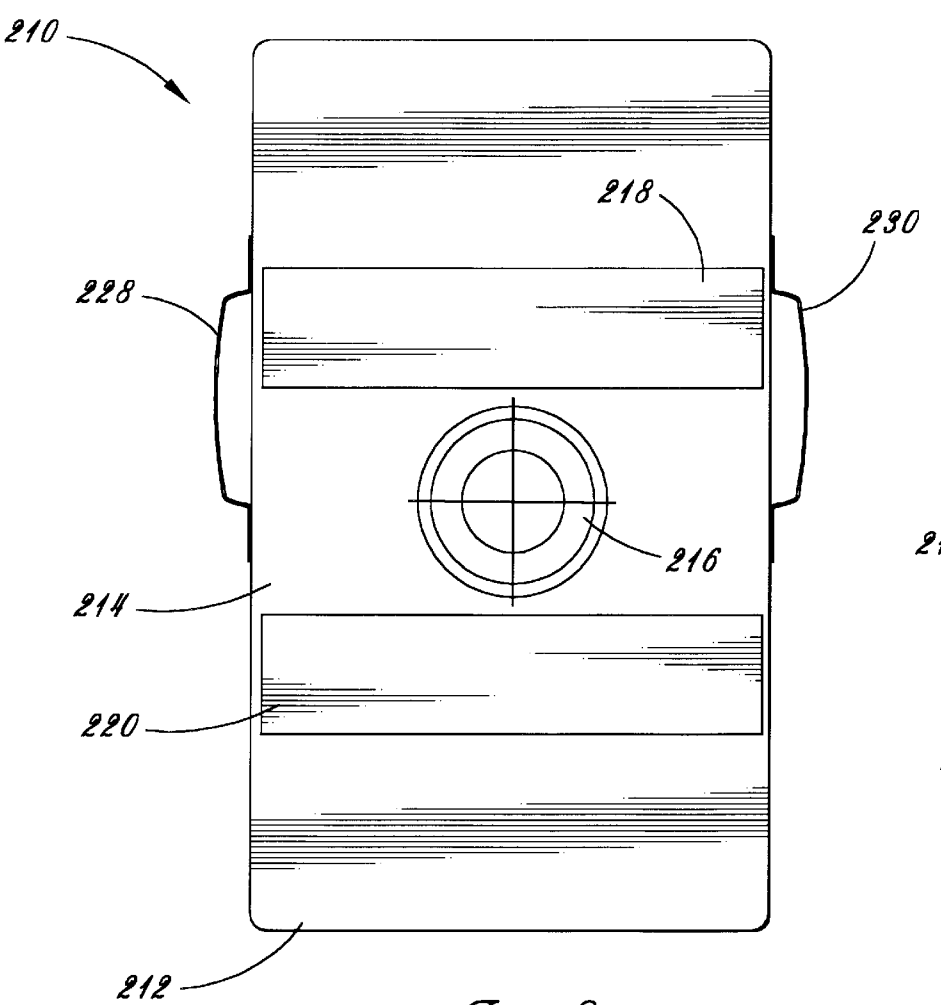
FIG. 8 is a front elevational view of a third embodiment of the protective target apparatus of the present invention.

Referring now to FIGS. 8 and 9, there is shown a third embodiment of the protective martial arts practice target pad 210 of a size having similar dimensions to that described in connection with the second embodiment shown in FIGS. 5–7. The practice target pad 210 has a base member 212 and a target area or space 214 defined by two linear or straight protrusions or walls 218, 220 positioned opposite one another in parallel relationship about a visual target 216. The protrusions or walls 218, 220 provide the upper and lower limits (in the orientation shown in FIGS. 8, 9) for the target space 214. In a different orientation, the protrusions 218, 220 may provide the lateral limitations of the target space 214, but in all cases restrict the striking space of the thrusts or blows of a practitioner or learner of the martial arts to the pre-defined target space 214.

The practice target pad 210 is similarly gripped and supported by straps across the rear of the base member 212 in a fashion similar to that described in connection with the second embodiment of the present invention. FIG. 9 shows strap 222 through which the arm of the user may be placed to support and stabilize the practice target pad 210. Further, as in the case of the second embodiment of the present invention, gripping straps 226, 228 and 230 are positioned at the top the back side of the practice target pad 210, and at the right and left lateral sides of the practice target pad 210, respectively, which have identical functions to the gripping straps discussed above in connection with the second embodiment of the present invention. Further, the dimensions of the larger practice target pad 210 are similar to those discussed with the second embodiment as described in connection with practice target pad 110 with the protrusions 218, 220 having dimensions similar to the walls 118, 120 forming the triangular target space 114 in connection with the second embodiment as described as practice target pad 110 above.

There are other shapes in which the practice target space may be configured other than the triangular and parallel wall configurations described up to this point. There may only be a single protrusion along the front of a practice target pad limiting the target space to the area above or below the protruding wall, or to the right or left of the protruding wall, depending upon the orientation of the practice target pad. Other configurations of protruding walls which entirely surround the practice target space are shown in FIGS. 10–12.

Figure 10:
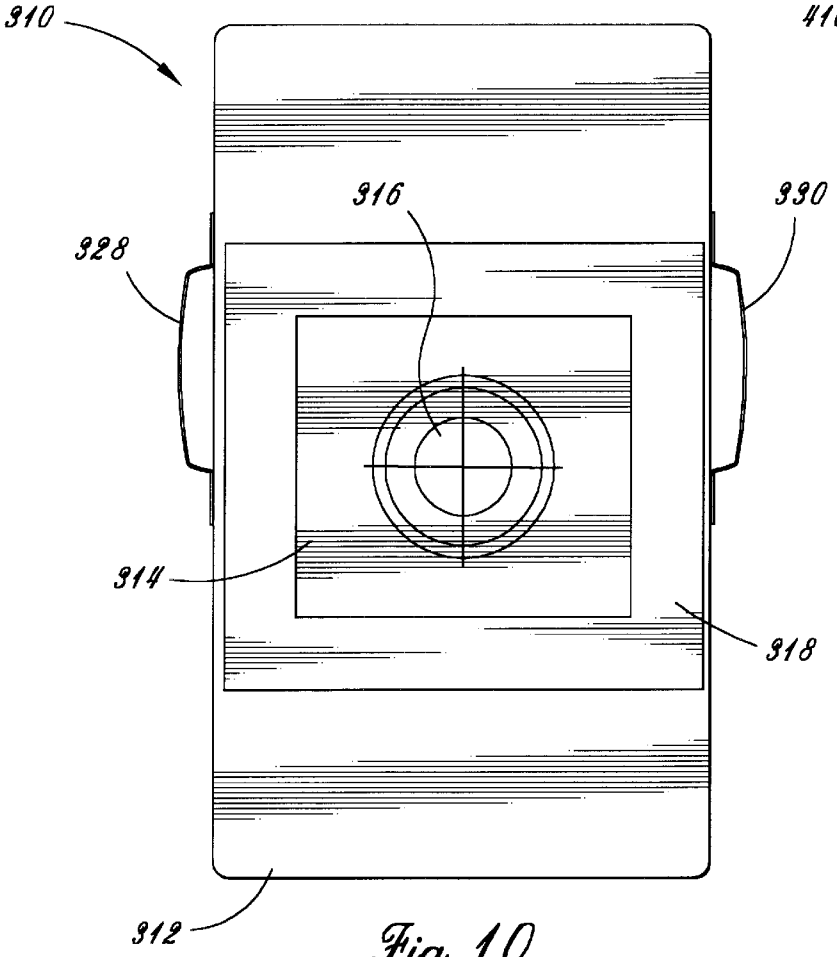
FIG. 10 is a front elevational view of the embodiment of FIG. 8 showing a protruding square practice target arrangement.

Referring to FIG. 10, there is shown a protective martial arts practice target pad 310 having a base member 312, side gripping straps 328, 330 and a target space 314. Surrounding the target space 314, but retained within the dimensions of the practice target pad 310, is a continuous protruding wall 318 comprised of four linear or straight walls attached at their respective ends to form a square target area 314 therebetween. A visual target 316 is also placed within the target space 314.

Figure 11:
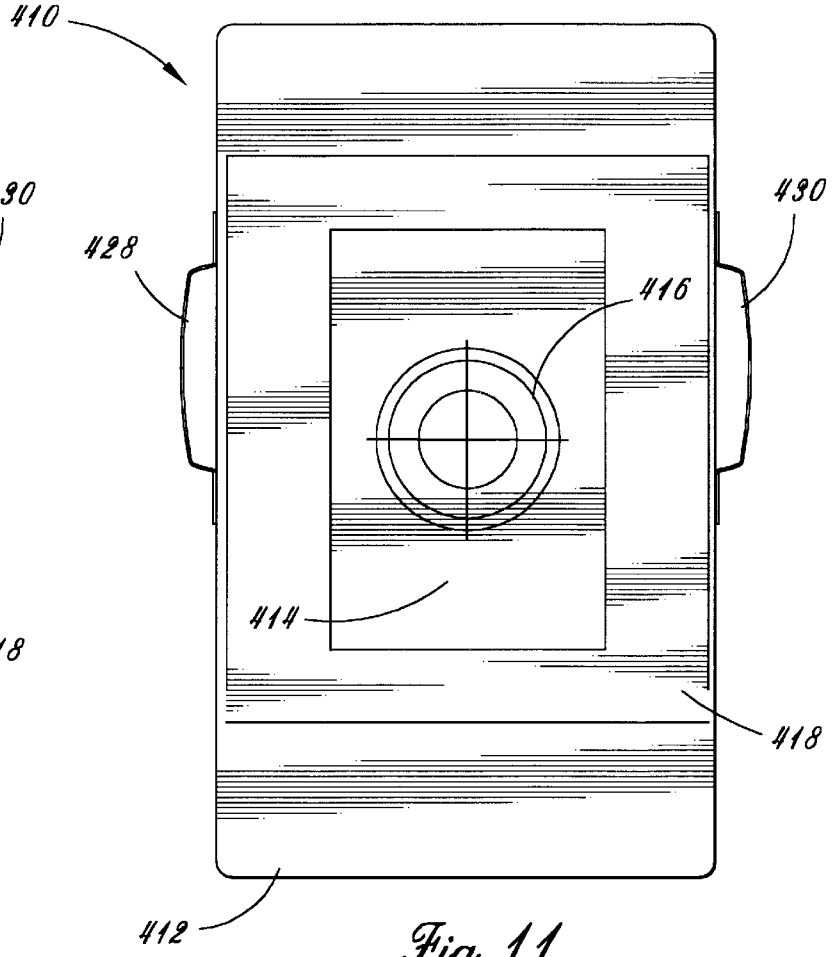
FIG. 11 is a front elevational view of the embodiment of FIG. 8 showing a protruding elongated rectangular practice target arrangement.

Referring to FIG. 11, there is shown a protective martial arts practice target pad 410 possessing all of the attributes previously described in connection with the embodiments discussed to date, including a base member 412, right and left gripping straps 428, 430 and a protruding wall 418 surrounding the target space 414. Also within the target space 414 is a visual target 416. The target space 414 is defined by the surrounding protruding wall 418 which defines a rectangular target space with the longer dimension following along the dimension of the base member 412 of the practice target 410. As in the earlier cases, the surrounding protruding wall 414 is comprised of four linear or straight walls, joined at their respective ends, to form the rectangular target space or area 414 therebetween. The dimension of the protruding wall 418 is similar to that previously described in connection with the other embodiments.

Figure 12:
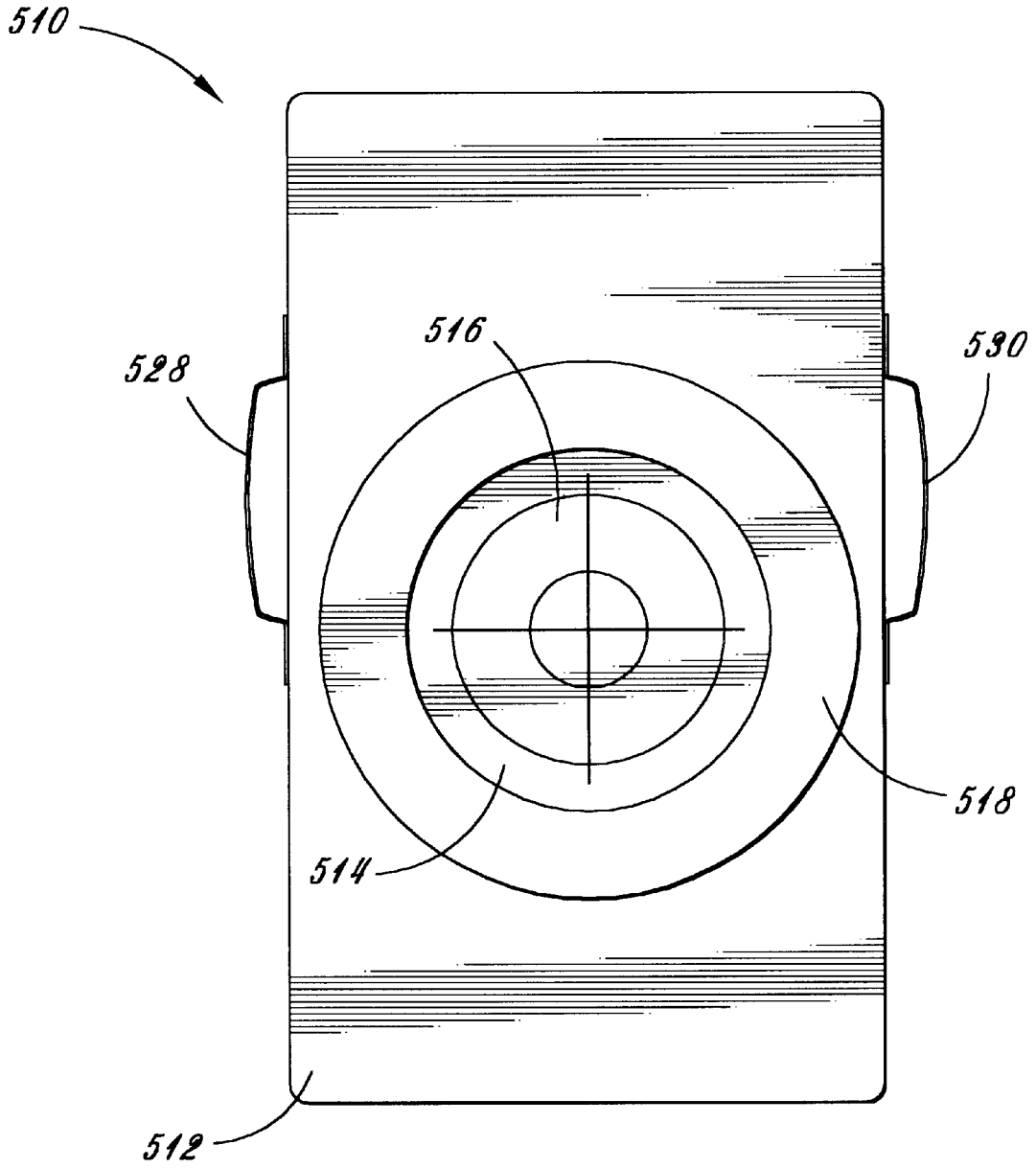
FIG. 12 is a front elevational view of the embodiment of FIG. 8 showing a protruding ellipsoidal or circular practice target arrangement.

Referring now to FIG. 12, there is shown another configuration of a target area or space which may be utilized with the present invention. The protective martial arts practice target pad 510 possesses the same attributes as that described earlier in connection with the other embodiments including a base member 510, right and left gripping straps 528, 530 and a protruding wall 518 surrounding the target space 514. As in the other embodiments, a visual target 516 is placed within the target area 514. In this case the target area is configured as a circle and a single curvilinear wall 518 surrounds the target area. Since a circle is a special form of ellipse, it is also possible that the target area may be configured as an ellipsoid. The dimensions of the protruding wall are similar to those previously described such that the protruding wall 518 extends outward from the front of the practice target pad 510 to form a targeting means to restrict thrusts or blows which are improperly made from falling within the designated target space. As with all of the embodiments, the various targeting means, i.e. the projecting walls, are dimensioned, placed and the target space configured to receive thrusts or blows from only proper martial arts positions and to receive thrusts or blows from improper positions on the protruding walls to provide both visual and physical feedback immediately to the practitioner or learner, as well as the instructor who holds the practice target pad, that the particular thrust or blow was either done properly or done improperly so that appropriate reinforcement or instruction can be immediately provided.

The present invention may be embodied in other specific forms without departing from the spirit or essential attributes thereof and, accordingly, the described embodiments are to be considered in all respects as being illustrative and not restrictive, with the scope of the invention being indicated by the appended claims, rather than the foregoing detailed description, as indicating the scope of the invention as well as all modifications which may fall within a range of equivalency which are also intended to be embraced therein.

I claim:

1. A protective target apparatus for use in the practice of various martial arts activities in which blows and thrusts are thrown at a human subject by a practitioner comprising:

a resilient energy-absorbing pad sized to protect the body area of the human subject at which one or more blows and thrusts are directed having a front and a back;

a support and gripping means for stabilizing and positioning the pad over the body area of the human subject at which the blows and thrusts are directed attached along the back of the pad; and a targeting means for directing the blows and thrusts to a restricted pre-determined target space defined by one or more non-breakaway protrusions integrally formed onto and extending substantially perpendicularly outward from the front of the pad and surrounding on one or more sides said target space and for providing immediate feedback to said practitioner by contact with said one or more protrusions indicating a misdirected blow or thrust or by lack of contact with said one or more protrusions indicating a properly directed blow or thrust falling within the pre-determined target space.

2. The protective target apparatus of claim 1, wherein said one or more protrusions comprises a single linear upstanding wall immediately adjacent to said target space.

3. The protective target apparatus of claim 1, wherein said one or more protrusions comprises a pair of linear upstanding parallel walls located on opposite sides of said target space.

4. The protective target apparatus of claim 1, wherein said targeting means further comprises a visual target display located within the target space toward which said blows and thrusts are to be directed.

5. The protective target apparatus of claim 1, wherein said support and gripping means comprising one or more retaining straps extending across the back of the pad for receiving the forearm and hand of the user and a gripping strap positioned along one side of the back of the pad to accommodate grasping by a user for stabilizing and for positioning the pad.

6. The protective target apparatus of claim 1, wherein said support and gripping means comprising one or more retaining straps extending across the back of the pad for receiving the forearm and hand of the user and at least one gripping strap positioned along one or more sides of the back of the pad, said at least one gripping strap positioned on the top or either side of the pad to accommodate grasping of the pad by the opposite hand of a user for stabilizing and for positioning the pad.

7. The protective target apparatus of claim 1, wherein the placement, arrangement and configuration of said one or more non-breakaway protrusions surrounding said target space are selectable from the group consisting of: one or more sets of two parallel aligned linear upstanding walls, rectangularly aligned linear upstanding walls, triangularly aligned linear upstanding walls, ellipsoidally aligned curvilinear upstanding walls, circularly aligned curvilinear upstanding walls, all having rectangular cross sections.

* * * * *